US012747917B2

(12) United States Patent
Nie et al.

(10) Patent No.: US 12,747,917 B2
(45) Date of Patent: Sep. 29, 2026

(54) COOLING DEVICE

(71) Applicant: BITMAIN TECHNOLOGIES INC., Beijing (CN)

(72) Inventors: Zesen Nie, Beijing (CN); Fengjie Li, Beijing (CN); Xiaoxiong Zhang, Beijing (CN); Haidie Chen, Beijing (CN)

(73) Assignee: BITMAIN TECHNOLOGIES INC., Beijing (CN)

( * ) Notice: Subject to any disclaimer, the term of this patent is extended or adjusted under 35 U.S.C. 154(b) by 139 days.

(21) Appl. No.: 18/648,258

(22) Filed: Apr. 26, 2024

(65) Prior Publication Data

US 2024/0361087 A1 Oct. 31, 2024

(30) Foreign Application Priority Data

Apr. 28, 2023 (CN) ..... 202321022802.3

(51) Int. Cl.
*F28F 3/04* (2006.01)

(52) U.S. Cl.
CPC ..... *F28F 3/048* (2013.01)

(58) Field of Classification Search
CPC ..... F28F 3/048; F28F 3/04; F28F 3/12; F28D 1/0308; F28D 1/0366; F28D 9/0031; F28D 9/0096
USPC ..... 165/109.1, 159, 170
See application file for complete search history.

(56) References Cited

U.S. PATENT DOCUMENTS 2,039,593 A * 5/1936 Hubbuch ..... F28F 3/12 165/170
4,282,927 A * 8/1981 Simmons ..... F28F 3/027 165/166
5,252,778 A * 10/1993 Ogawa ..... H01F 27/20 174/15.1
5,881,805 A * 3/1999 Inoue ..... F28D 1/0341 165/176
6,863,120 B2 * 3/2005 Hwang ..... F28F 3/044 165/174
6,935,412 B2 * 8/2005 Mueller ..... H10W 40/47 174/15.1
7,093,649 B2 * 8/2006 Dawson ..... F28D 9/0031 165/170
7,264,045 B2 * 9/2007 Mehendale ..... F28D 1/0341 165/170
7,293,423 B2 * 11/2007 Upadhya ..... F28F 3/12 165/146
9,671,179 B2 * 6/2017 Mori ..... F28F 3/12
9,893,392 B2 * 2/2018 Vanderwees ..... F28F 3/12
(Continued)

OTHER PUBLICATIONS

Notification of Grant of Utility Model Patent Rights dated Sep. 11, 2023 for Chinese Application No. 2023210228023.

*Primary Examiner* — Claire E Rojohn, III

(57) ABSTRACT

The present application provides a cooling device. The cooling device includes a first plate body and a second plate body, where a first surface of the first plate body is provided with a flow channel, the flow channel is configured to accommodate fluid, the flow channel includes at least two straight segments and at least one bent segment, the at least two straight segments are communicated via the at least one bent segment, the first surface of the first plate body is in contact with the second plate body. The cooling device of the present application has an enhanced heat dissipation performance.

9 Claims, 6 Drawing Sheets

(56) References Cited

U.S. PATENT DOCUMENTS 10,014,236 B2 * 7/2018 Adachi ..... H05K 7/20927
11,160,191 B2 * 10/2021 Tsai ..... H05K 7/20254
11,175,102 B1 * 11/2021 Harrington ..... F28F 3/12
11,254,236 B2 * 2/2022 Dziubinschi ..... H01M 10/613
11,662,158 B2 * 5/2023 Forst ..... F28D 1/0341 165/153
12,263,759 B2 * 4/2025 Crosatti ..... H01M 10/6554
2002/0195237 A1 * 12/2002 Luz ..... F28D 9/0043 165/178
2004/0144523 A1 * 7/2004 Higashiyama ..... F28F 9/0246 165/178
2005/0145379 A1 * 7/2005 Thomas ..... F28F 3/12 165/170
2006/0225867 A1 * 10/2006 Park ..... F28F 9/0263 165/170
2006/0243431 A1 * 11/2006 Martin ..... F28D 1/0308 165/170
2007/0050980 A1 * 3/2007 Vetter ..... B23K 11/14 257/E23.098
2009/0183861 A1 * 7/2009 Kuhnel ..... F28D 7/106 165/165
2013/0153186 A1 * 6/2013 Gotou ..... F28F 3/025 165/168
2021/0254895 A1 * 8/2021 Vakilimoghaddam ..... F28D 1/035
2021/0381730 A1 * 12/2021 Dittly ..... F28D 1/0476
2021/0389053 A1 * 12/2021 Lo ..... F28D 1/035
2023/0314091 A1 * 10/2023 Ranjan ..... F28D 1/0366 165/181
2024/0361087 A1 * 10/2024 Nie ..... F28F 3/022
2024/0363921 A1 * 10/2024 Brown ..... F28F 21/06
2024/0365504 A1 * 10/2024 Nie ..... H05K 7/20254
2025/0046911 A1 * 2/2025 Li ..... F28F 3/12
2025/0260086 A1 * 8/2025 Hur ..... F28F 3/12
2026/0181822 A1 * 6/2026 Fu ..... H05K 7/20263

* cited by examiner

COOLING DEVICE

CROSS-REFERENCE TO RELATED APPLICATIONS

This application claims priority to Chinese Patent Application No. 202321022802.3, filed on Apr. 28, 2023, which is hereby incorporated by reference in its entirety.

TECHNICAL FIELD

The present disclosure relates to, but is not limited to the technical field of cooling devices and, in particular, to a cooling device.

BACKGROUND

The cooling device achieves heat dissipation of a heating device through heat exchange between a flowing internally fluid and the heating device. A goal pursued by those skilled in the art is to continuously enhance a heat dissipation effect of the cooling device.

In view of this, a problem of the present application is how to enhance the heat dissipation effect of the cooling device.

SUMMARY

The present application provides a cooling device with an enhanced heat dissipation effect.

The present application provides a cooling device. The cooling device includes a first plate body and a second plate body, a first surface of the first plate body is provided with a flow channel for accommodating a fluid, the flow channel includes at least two straight segments and at least one bent segment, the at least two straight segments are communicated via the at least one bent segment, and the first surface of the first plate body is in contact with the second plate body.

Herein, the flow channel is configured to have at least two straight segments and at least one bent segment. This is beneficial for increasing an overlapping area between the flow channel and a heating device, thereby promoting heat exchange between the fluid and the heating device, so that the cooling device has an excellent heat dissipation effect.

In some possible implementations, the first plate body and the second plate body are formed by casting.

In these implementations, the first plate body and the second plate body are formed by casting. Due to that the casting can form all flow channels in one casting process, manufacturing time of the cooling device is greatly reduced. In addition, the casting of the first plate body and the second plate body only requires the use of a specific mold, thereby reducing a processing cost of the cooling device. Furthermore, by using different molds, different flow channels can be obtained in the cooling device, thereby it is easy to achieve diverse flow channel arrangements.

In some possible implementations, the first plate body and the second plate body are integrally formed by welding.

In these implementations, the first plate body and the second plate body are integrally formed by brazing, thereby achieving an assembly of the first plate body and the second plate body. In this way, the use of brazing technology improves an assembly speed of the first plate body and the second plate body, further shortening the manufacturing time of the cooling device.

At the same time, the flow channel is configured to have at least two straight segments and at least one bent segment. This is beneficial for increasing the overlapping area between the flow channel and the heating device, thereby promoting heat exchange between the fluid and the heating device, so that the cooling device has a strong heat dissipation effect.

In some possible implementations, an end of the flow channel is provided with an inlet and outlet nozzle, the inlet and outlet nozzle is configured for the fluid entering into and exiting from the flow channel, and the inlet and outlet nozzle is connected to the flow channel at an obtuse angle.

In these implementations, by setting the inlet and outlet nozzle to be connected to the flow channel at an obtuse angle, a flow resistance of the fluid at the inlet and outlet nozzle is reduced, thereby promoting flowing of the fluid in the flow channel.

In some possible implementations, a bottom surface of the flow channel is provided with a micro rib structure.

In these implementations, the micro rib structure provided on the bottom surface of the flow channel can cause disturbance to the fluid flowing in the flow channel. This disturbance can promote heat exchange between the fluid and the heating device, rendering the cooling device to have an excellent heat dissipation effect. In addition, the micro rib structure can also serve as a support between the first plate body and the second plate body, thereby enhancing the strength of the cooling device.

In some possible implementations, there are a plurality of micro rib structures, the plurality of micro rib structures are arranged within the flow channel in a staggered manner.

In these implementations, the plurality of micro rib structures arranged within the flow channel in a staggered manner can further enhance the disturbance of the fluid in the flow channel, so that the cooling device has an excellent heat dissipation effect.

In some possible implementations, a first mounting hole may be provided within the first plate body; the first mounting hole is located in at least one micro rib structure of the plurality of micro rib structures, and the first mounting hole is configured to mount a heating device.

In these implementations, the first mounting hole is provided in the micro rib structure. Due to the fact that micro rib structures can be arranged at different positions in the flow channel, and the micro rib structures can have different sizes and shapes, various positions, sizes, and structures of the micro rib structures can meet the mounting requirements of various heating devices.

In some possible implementations, a first surface of the second plate body may be in contact with the first surface of the first plate body, a strip-shaped protrusion may be provided on the first surface of the second plate body; the strip-shaped protrusion overlaps with a part of the flow channel, and an extension direction of the strip-shaped protrusion is the same as an extension direction of the flow channel.

In these implementations, the strip-shaped protrusion on the first surface of the second plate body allows the flow channel to have different heights and shapes, so that the flow channel can have different cross-section shapes.

It should be understood that the above general descriptions and detailed descriptions in the following are only illustrative and explanatory, and cannot limit the present application.

BRIEF DESCRIPTION OF DRAWINGS

The accompanying drawings herein, which are incorporated into this specification and form a part of this specification, illustrate embodiments that are in accordance with the present application and are used together with the specification to explain the principles of the present application.

Description of reference signs: 1: cooling device; 10: first plate body; 20: second plate body; 11: flow channel; 11A: straight segment; 11B: bent segment; 12: wall; 13: inlet and outlet nozzle; 14: micro rib structure; 15: first mounting hole; 21: second mounting hole; 13A: uniform segment; 13B: transition segment; H: first height; h: second height; β: transition angle; 22: strip-shaped protrusion.

DESCRIPTION OF EMBODIMENTS

In the following description, specific details of, for example, structure, device, and technology are proposed for purpose of illustration rather than limitation, in order to thoroughly understand the embodiments of the present application. However, those skilled in the art should be noted that the technical solution of the present application can also be implemented in other embodiments without these specific details. Detailed descriptions of well-known structures, device and methods in other cases are omitted to avoid unnecessary details that may hinder the description of embodiments in the present application.

The embodiment of the present application provides a cooling device. This cooling device can be used for heat dissipating (or cooling) a heating device. In some scenarios, the heating device can be an electronic device. For example, the electronic device can be a central processing unit (CPU), a graphics processing unit (GPU), a digital signal processor (DSP), or other integrated circuit chips. In some scenarios, the heating device can also be an electrical device. For example, the electrical device can be a power module or other electrical devices. It can be understood that the heating device can be any heating equipment, apparatus or device, and the embodiments of the present application have no specific limitation on this.

Figure 1:
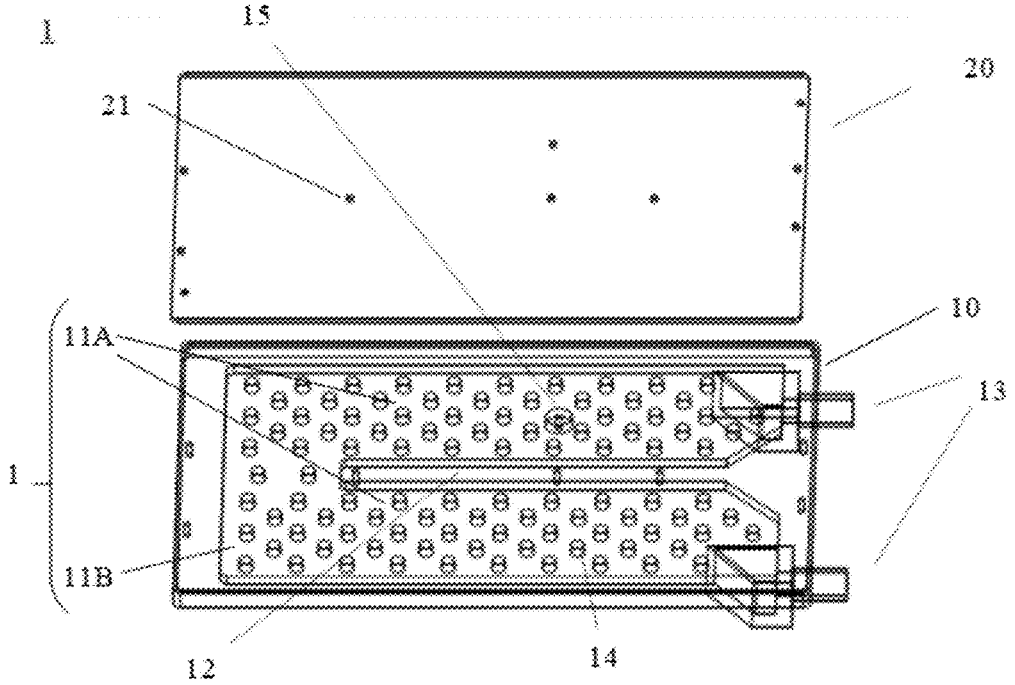
FIG. 1 is an exploded view of a cooling device in an embodiment of the present application.

FIG. 1 is an exploded view of a cooling device in an embodiment of the present application. As shown in FIG. 1, the cooling device 1 includes a first plate body 10 and a second plate body 20. A first surface of the first plate body 10 is provided with a flow channel 11. The flow channel 11 is configured to accommodate a fluid. The flow channel 11 includes at least two straight segments 11A and at least one bent segment 11B, the at least two straight segments 11A are communicated via the at least one bent segment 11B. The first plate body 10 and the second plate body 20 are formed by casting. The first plate body 10 and the second plate body 20 are integrally formed by welding. The first surface of the first plate body 10 is in contact with the second plate body 20.

In this embodiment, the flow channel 11 is configured to have at least two straight segments 11A and at least one bent segment 11B. This is beneficial for increasing an overlapping area between the flow channel 11 and the heating device, thereby promoting heat exchange between the fluid and the heating device and rendering the cooling device 1 to have a strong heat dissipation effect.

In FIG. 1, the first surface of the first plate body 10 is facing up, and a second surface thereof is facing down; a first surface of the second plate body 20 is facing down, and a second surface thereof is facing up.

In this embodiment, the flow channel 11 formed by the at least two straight segments 11A and the least one bent segment 11B can be considered as a "C" shape. In this case, the at least two straight segments 11A are arranged in parallel. The at least two straight segments 11A are communicated at the same end via the at least one bent segment 11B. The at least two straight segments 11A are separated by a wall 12. Therefore, the wall 12 can be referred to as a channel partition.

The first plate body 10 and the second plate body 20 are assembled together. In an embodiment, the first plate body 10 and the second plate body 20 may be formed by casting. Due to that the flow channel 11 is provided within the first surface of the first plate body 10, a development of mold used in the casting needs to take into account the flow channel 11 of the first plate body 10. In an example, the first plate body 10 and the second plate body 20 can be formed by pressure casting. It can be understood that the first plate body 10 and the second plate body 20 can also be made using other casting processes, or a process other than casting. The embodiments of the present application have no specific limitation on this.

Herein, the first plate body 10 and the second plate body 20 are formed by casting. Due to the casting can form all flow channels 11 in one casting process, manufacturing time of the cooling device 1 is greatly reduced. In addition, the casting of the first plate body 10 and the second plate body 20 only requires the use of a specific mold, thereby reducing a processing cost of the cooling device 1. Furthermore, by using different molds, different flow channels 11 can be obtained in the cooling device 1, so that it is easy to achieve diverse flow channel arrangements.

In an embodiment, the first plate body 10 and the second plate body 20 are integrally formed by welding. The first surface of the first plate body 10 is in contact with the first surface of the second plate body 20. In an embodiment, the first plate body 10 and the second plate body 20 can be integrally formed by tunnel brazing. Specifically, materials such as soldering paste, flux and other material are first added to a contact area between the first surface of the first plate body 10 and the first surface of the second plate body 20, and then, a smelting tool is used to press the first plate body 10 and the second plate body 20 together. After pressed together, the first plate body 10 and the second plate body 20 are sent into a tunnel brazing furnace for welding. Here, the first plate body 10 and the second plate body 20 become one piece by brazing, thereby achieving the assembly of the first plate body 10 and the second plate body 20. In this way, the use of brazing process improves an assembly speed of the first plate body 10 and the second plate body 20, thereby further reducing the manufacturing time of the cooling device 1. It can be understood that the first plate body 10 and the second plate body 20 can also be connected using other welding methods such as arc welding, laser beam welding and electric resistance welding, or other methods such as bolt fixation and snap fixation. The embodiments of the present application have no specific limitation on this.

The flow channel 11 is provided within the first surface of the first plate body 10. In other words, the flow channel 11 is a channel provided within the first surface of the first plate body 10 to allow fluid flowing.

In the embodiments of the present application, since the flow channel 11 is C-shaped, the flow channel 11 can occupy as large area as possible on the first surface of the first plate body 10. This is beneficial for increasing the overlapping area between the flow channel 11 and the heating device, thereby promoting heat exchange between the fluid and the heating device, and rendering the cooling device 1 to have a strong heat dissipation effect.

In an embodiment, a bottom surface of the flow channel 11 in the first plate body 1 may be flat. It can be understood that the bottom surface of the flow channel 11 in the first plate body 1 may also have other shapes, and the embodiments of the present application have no specifical limitation on this.

In an embodiment, an end of the flow channel 11 is provided with an inlet and outlet nozzle 13. The inlet and outlet nozzle 13 is used for fluid entering into and exiting from the flow channel 11. The inlet and outlet nozzle 13 is communicated with the flow channel 11 at an obtuse angle.

The inlet and outlet nozzle 13 is tubular and can have various cross-section shapes. For example, the cross-section shape of the inlet and outlet nozzle 13 can be rectangular, square, circular, elliptical, trapezoidal, or other shape.

Figure 2:
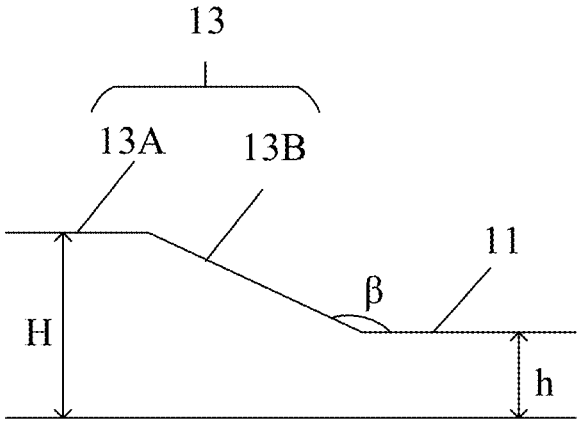
FIG. 2 is a cross-section view of a part of a flow channel communicating with an inlet and outlet nozzle at an obtuse angle in an embodiment of the present application.

FIG. 2 is a cross-section view of a connection part of a flow channel communicating with an inlet and outlet nozzle at an obtuse angle in an embodiment of the present application. As shown in FIG. 2, the inlet and outlet nozzle 13 can include a uniform segment 13A and a transition segment 13B. The uniform segment 13A has a first height H. The first height H of the uniform segment 13A is greater than a second height h of the flow channel 11. A height of the transition segment 13B changes from the first height H of the uniform segment 13A to the second height h of the flow channel 11.

In an embodiment, as shown in FIG. 2, the uniform segment 13A, the transition segment 13B, and the flow channel 11 may be connected to each other in a bend manner. In an embodiment, the uniform segment 13A, the transition segment 13B, and the flow channel 11 can be smoothly connected.

It can be seen that a transition angle β formed by a top surface of the transition segment 13B and the flow channel 11 is an obtuse angle. Therefore, the inlet and outlet nozzle 13 and the flow channel 11 are considered to be communicated with each other at an obtuse angle.

In the embodiment of the present application, by setting the inlet and outlet nozzle 13 to be communicated with the flow channel 11 at an obtuse angle, a flow resistance of the fluid at the inlet and outlet nozzle 13 is reduced, thereby promoting flowing of the fluid in the flow channel 11.

In an embodiment, a micro rib structure 14 can be provided on a bottom surface of the flow channel 11. Specifically, the micro rib structure 14 is a protrusion part on the bottom and/or side surface of the flow channel 11.

Figure 3A:
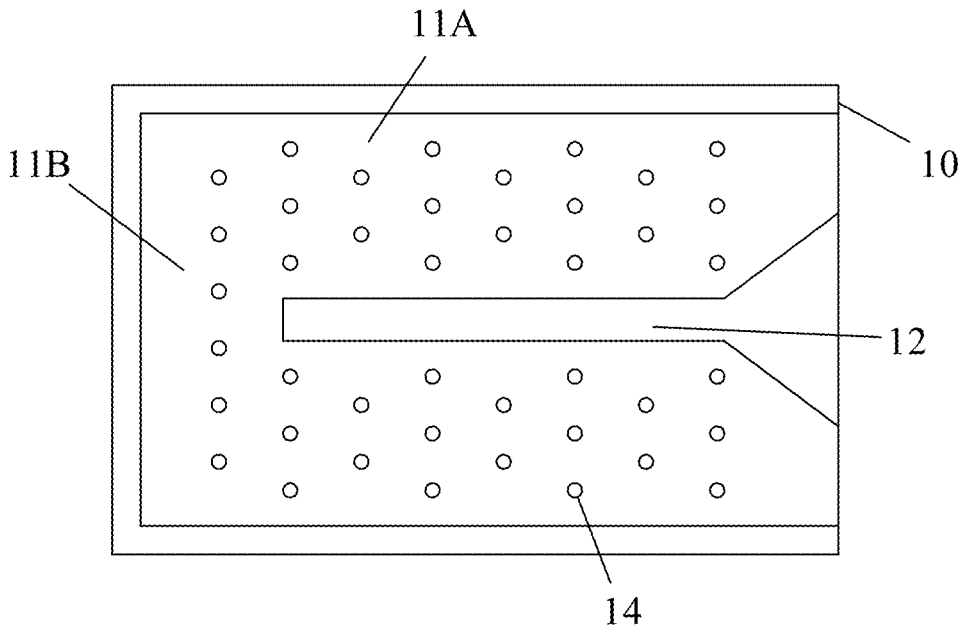
FIG. 3A is a schematic diagram of a first example of an arrangement of a micro rib structure in a flow channel in an embodiment of the present application.
Figure 3B:
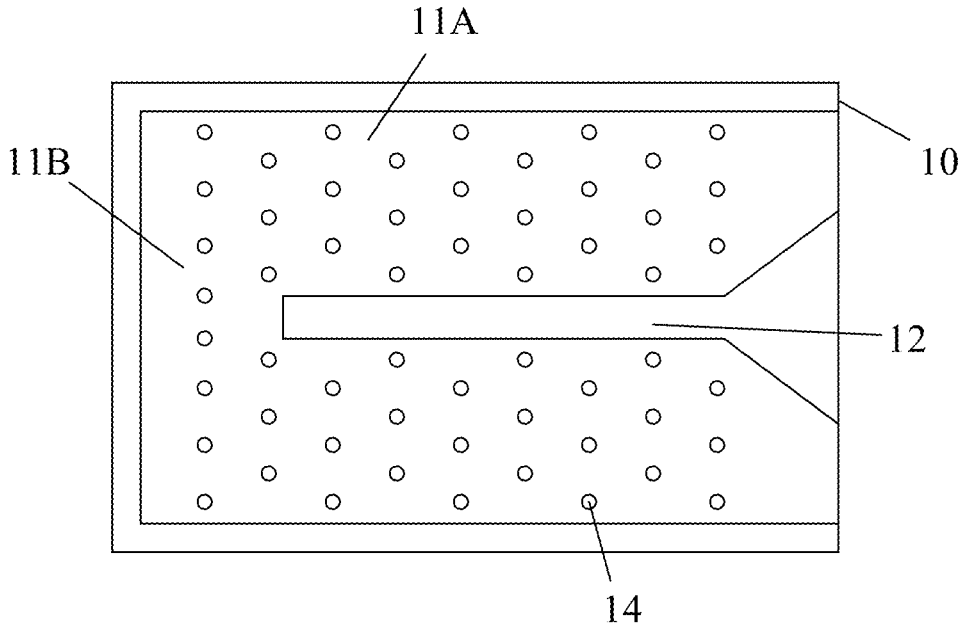
FIG. 3B is a schematic diagram of a second example of an arrangement of a micro rib structure in a flow channel in an embodiment of the present application.
Figure 3C:
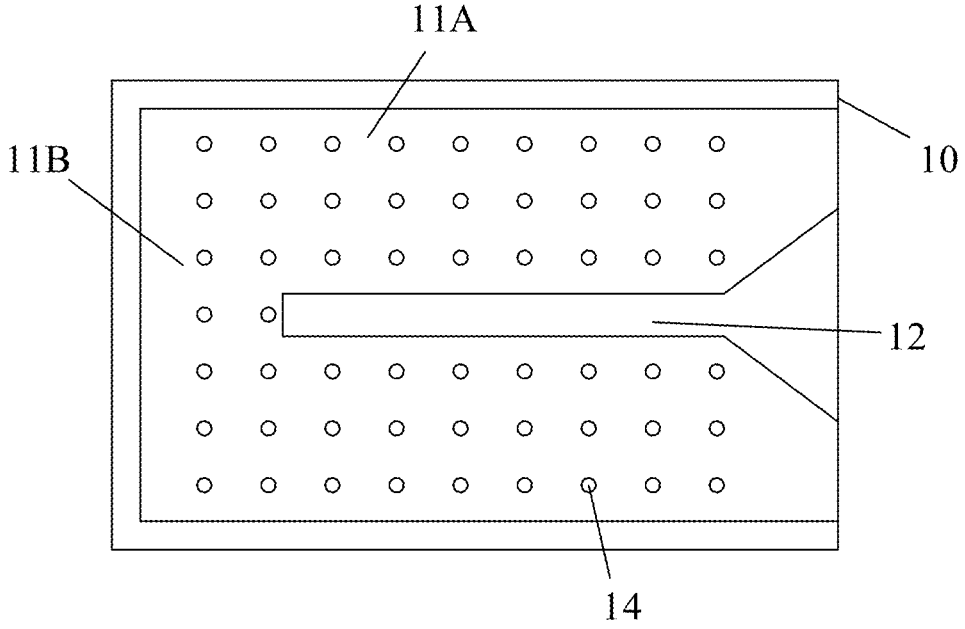
FIG. 3C is a schematic diagram of a third example of an arrangement of micro rib structure in a flow channel in an embodiment of the present application.

One or more micro rib structures 14 can be provided in the flow channel 11 of the first plate body 10. In most cases, there are a plurality of micro rib structures 14. FIGS. 3A to 3C are schematic diagrams of multiple examples of arrangements of the micro rib structures in the flow channel in embodiments of the present application.

In the embodiments of the present application, the micro rib structure 14 provided on the bottom surface of the flow channel 11 can cause a disturbance to the fluid flowing in the flow channel 11. Such disturbance can promote heat exchange between the fluid and the heating device, so that the cooling device 1 has a strong heat dissipation effect.

In an example, as shown in FIG. 3A, the micro rib structure 14 is arranged in the flow channel 11 in a first array mode. In the first array mode, a plurality of micro rib structures 14 can be arranged within the flow channel 11 in a staggered manner. Specifically, multiple rows of micro rib structures 14 can be arranged along an extension direction of the flow channel 11. The multiple rows of micro rib structures 14 can have different numbers of micro rib structures 14, and two adjacent rows of micro rib structures 14 are arranged in a staggered manner.

In an example, as shown in FIG. 3B, the micro rib structure 14 is arranged in the flow channel 11 in a second array mode. In the second array mode, a plurality of micro rib structures 14 can be arranged within the flow channel 11 in a staggered manner. Specifically, multiple rows of micro rib structures 14 can be arranged along an extension direction of the flow channel 11. The multiple rows of micro rib structures 14 can have the same number of micro rib structures 14, and two adjacent rows of micro rib structures 14 are arranged in a staggered manner.

In an example, as shown in FIG. 3C, the micro rib structure 14 is arranged in the flow channel 11 in a third array mode. In the third array mode, a plurality of micro rib structures 14 can be arranged in the flow channel 11 in an aligned manner. Specifically, multiple rows of micro rib structures 14 can be arranged along an extension direction of the flow channel 11. The multiple rows of micro rib structures 14 can have the same number of micro rib structures 14, and micro rib structures 14 at corresponding positions in the multiple rows of micro rib structures 14 are aligned with each other.

It can be understood that the micro rib structures 14 in the flow channel 11 can also be arranged in other ways, and the embodiments of the present application have no specific limitation on this.

In an embodiment, the micro rib structure 14 may be cylindrical in shape. In this case, the extension direction of the micro rib structure 14 can be perpendicular to a plane where the first plate body 1 is located, and a length of the micro rib structure 14 is the same as the height of the flow channel 11. In this way, a top surface of the micro rib structure 14 can be flush with the first surface of the first plate body 10. At this time, the micro rib structure 14 can also serve as a support between the first plate body 10 and the second plate body 20, thereby enhancing the strength of the cooling device 1.

FIGS. 4A to 4D are schematic diagrams of multiple examples of a micro rib structure in embodiments of the present application.

Figure 4A:
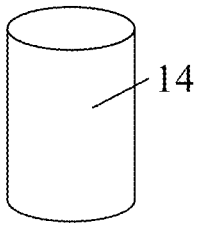
FIG. 4A is a schematic diagram of a first example of a micro rib structure in an embodiment of the present application.

In an example, as shown in FIG. 4A, the micro rib structure 14 can be in a shape of cylinder.

Figure 4B:
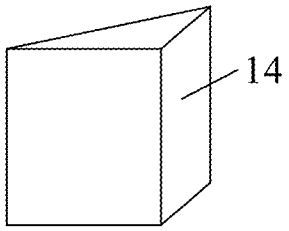
FIG. 4B is a schematic diagram of a second example of a micro rib structure in an embodiment of the present application.

In an example, as shown in FIG. 4B, the micro rib structure 14 can be in a shape of triangular prism.

Figure 4C:
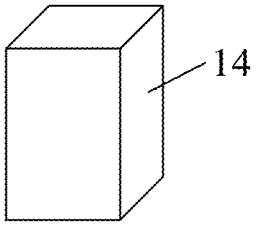
FIG. 4C is a schematic diagram of a third example of a micro rib structure in an embodiment of the present application.

In an example, as shown in FIG. 4C, the micro rib structure 14 can be in a shape of cuboid.

It can be understood that the micro rib structure 14 can be in other column shapes or in a shape (such as a cone) other than column shape, and the embodiments of the present application have no specific limitation on this.

In the embodiment of the present application, a plurality of micro rib structures 14 arranged within the flow channel 11 in a staggered manner can further enhance the disturbance of the fluid in the flow channel 11, so that the cooling device 1 has a strong heat dissipation effect.

The cooling device 1 in the embodiment of the present application is used for cooling the heating device. For this reason, the first plate body 10 and/or the second plate body 20 can be in contact with the heating device to achieve heat exchange between the fluid in the flow channel 11 and the heating device. In order to achieve a stable heat exchange between the cooling device 1 and the heating device, the heating device can be fixed to the cooling device 1.

In an embodiment, the heating device can be fixed to the cooling device 1 by bonding. In this case, an adhesive can be used to fix the heating device to the cooling device 1.

In an embodiment, the heating device can be fixed to the cooling device 1 by a screw. In this case, the cooling device 1 can be provided with a first mounting hole 15 and a second mounting hole 21 for the screw to pass through. The first mounting hole 15 is located inside the first plate body 10. The second mounting hole 21 is located inside the second plate body 20. The first mounting hole 15 is aligned with the second mounting hole 21. The positions of the first mounting hole 15 and the second mounting hole 21 in the first plate body 10 and the second plate body 20 can be determined based on a mounting position of the heating device.

The first mounting hole 15 is configured to avoid the fluid in the flow channel 11. In an embodiment, the first mounting hole 15 may be located at the wall 12 of the flow channel 11. In an embodiment, the first mounting hole 15 may be located at an edge of the first plate body 10. In an embodiment, the first mounting hole 15 may be located at the micro rib structure 14 in the flow channel 11.

Figure 5:
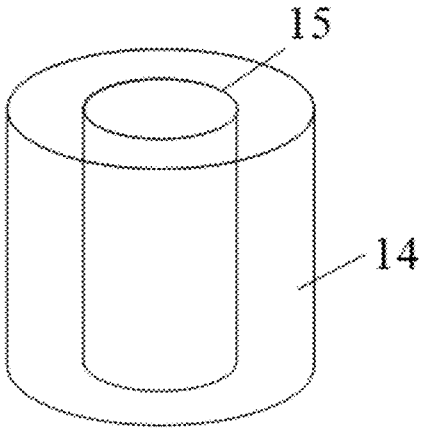
FIG. 5 is a perspective view of an example of a micro rib structure with a first mounting hole in an embodiment of the present application.

FIG. 5 is a perspective view of an example of a micro rib structure with a first mounting hole in an embodiment of the present application. As shown in FIG. 5, at least one micro rib structure 14 in the flow channel 11 of the first plate body 10 is provided with a first mounting hole 15. The first mounting hole 15 corresponds to a second mounting hole 21 in the second plate body 20.

In the embodiment of the present application, the first mounting hole 15 is provided in the micro rib structure 14. Due to the fact that the micro rib structure 14 can be arranged at different positions in the flow channel 11, and the micro rib structure 14 can have different sizes and shapes, various positions, sizes, and structures of the micro rib structure 14 can meet the mounting requirements of various heating devices.

In an embodiment, the first surface of the second plate body 20 can be in contact with the first surface of the first plate body 10, and a strip-shaped protrusion can be provided on the first surface of the second plate body 20. The strip-shape protrusion overlaps with a part of the flow channel 11. An extension direction of the strip-shaped protrusion is the same as that of the flow channel 11.

Figure 6A:
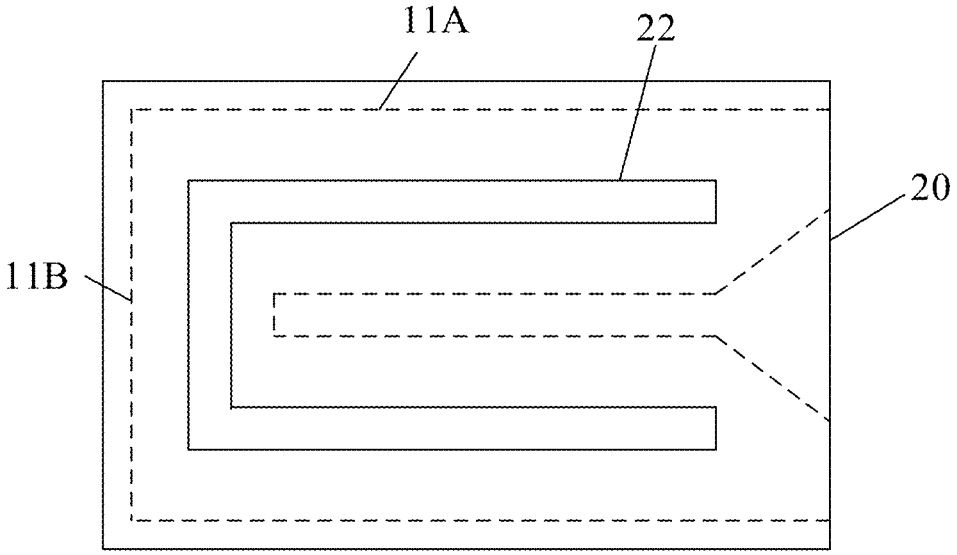
FIG. 6A is a schematic diagram of a first example of an arrangement of a strip-shaped protrusion on a second plate body in an embodiment of the present application.
Figure 6B:
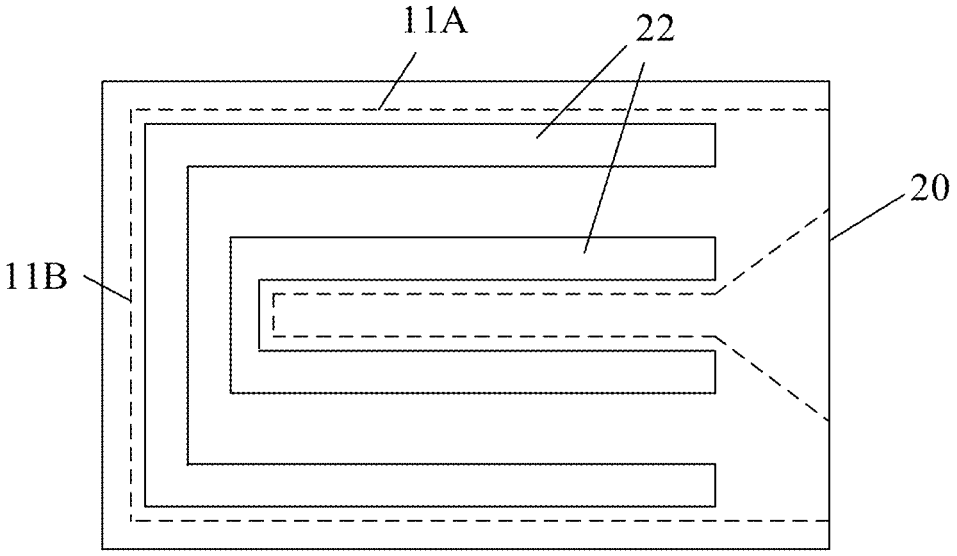
FIG. 6B is a schematic diagram of a second example of an arrangement of a strip-shaped protrusion on a second plate body in an embodiment of the present application.

The strip-shaped protrusion can have multiple arrangement modes. FIGS. 6A and 6B are schematic diagrams of multiple examples of arrangement of the strip-shaped protrusion on the second plate body in embodiments of the present application.

In an example, as shown in FIG. 6A, one strip-shaped protrusion 22 can be provided on the second plate body 20. The strip-shaped protrusion 22 extends in the same direction as the extension direction of the flow channel 11 at a middle position of the flow channel 11, and the strip-shaped protrusion 22 extends in the straight segment 11A and the bent segment 11B.

In one example, as shown in FIG. 6B, two strip-shaped protrusions 22 can be provided on the second plate body 20. The two strip-shaped protrusions 22 extend in the same direction as the extension direction of the flow channel 11 at two sides of the flow channel 11, and the strip-shaped protrusions 22 extend in the straight segment 11A and the bent segment 11B.

Figure 6C:
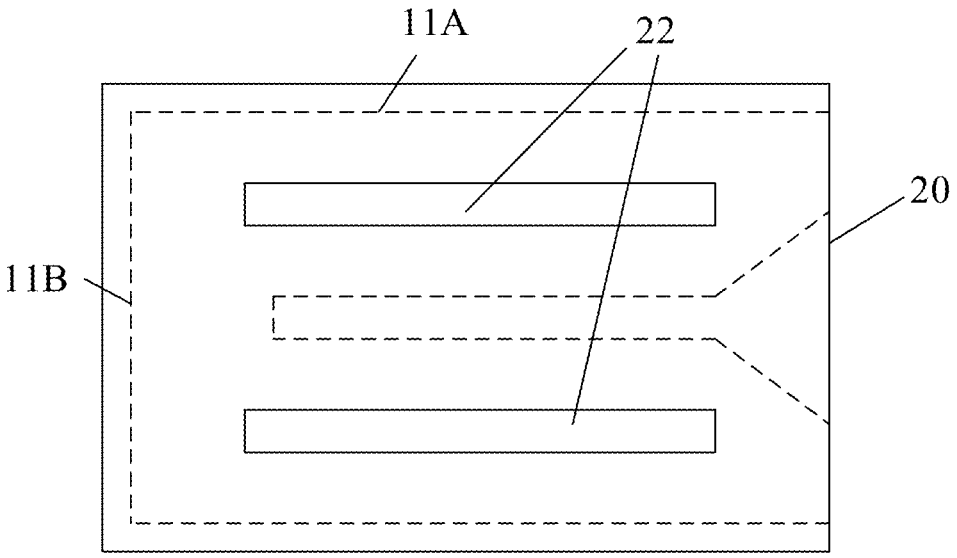
FIG. 6C is a schematic diagram of a third example of an arrangement of a strip-shaped protrusion on a second plate body in an embodiment of the present application.

In an example, as shown in FIG. 6C, two strip-shaped protrusions 22 can be provided on the second plate body 20. The two strip-shaped protrusions 22 are located at positions of the at least two straight segments 11A of the flow channel 11, respectively. Each strip-shaped protrusion 22 extends along the extension direction of a corresponding straight segment 11A at a middle position of the corresponding straight segment 11A, and an extension length of each strip-shaped protrusion 22 is the same as a length of the corresponding straight segment 11A.

It can be understood that the strip-shaped protrusion 22 may also have other arrangements, and the embodiments of the present application have no specific limitation on this.

Figure 7A:
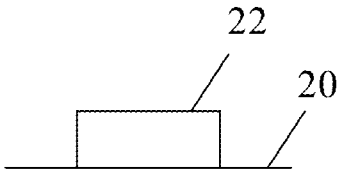
FIG. 7A is a schematic diagram of a first example of a cross-section shape of a strip-shaped protrusion on a second plate body in an embodiment of the present application.
Figure 7B:
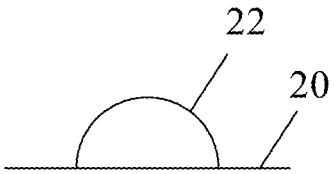
FIG. 7B is a schematic diagram of a second example of a cross-section shape of a strip-shaped protrusion on a second plate body in an embodiment of the present application.

The strip-shaped protrusions can have multiple cross-section shapes. FIGS. 7A and 7B are schematic diagrams of multiple examples of cross-section shapes of the strip-shaped protrusion on the second plate body in embodiments of the present application.

In an example, as shown in FIG. 7A, a cross-section shape of the strip-shaped protrusion 22 on the second plate body 20 can be rectangular. In this case, a top surface of the strip-shaped protrusion 22 can be a plane surface.

In an example, as shown in FIG. 7B, the cross-section shape of the strip-shaped protrusion 22 on the second plate body 20 can be semi-circular. In this case, the top surface of the strip-shaped protrusion 22 can be an arc-shaped surface.

It can be understood that the strip-shaped protrusion 22 may also have other cross-section shapes, the embodiments of the present application have no specific limitation on this.

In addition, a height of the strip-shaped protrusion can be set according to actual needs. In an example, the height of the strip-shaped protrusion 22 may be less than or equal to half of the height of the flow channel 11. In an example, the height of the strip-shaped protrusion 22 can be greater than half of the height of the flow channel 11. It can be understood that the height of the strip-shaped protrusion 22 may be smaller than the height of the flow channel 11.

In this implementation, the strip-shaped protrusion 22 on the first surface of the second plate body 20 allows the flow channel 11 to have different heights and shapes, so that the flow channel 11 can have different cross-section shapes.

It should be noted that the first plate body 10 and the second plate body 20 of the cooling device 1 in the embodiments of the present application can be formed of aluminum alloy or other metal materials, and the embodiments of the present application have no specific limitation on this.

In addition, after obtaining the cooling device 1 by pressure casting and brazing, subsequent processing and treatment of the cooling device 1 can be carried out. These processing and treatment include but are not limited to thread processing and surface treatment.

After the production of the cooling device 1 is completed, it is necessary to test the cooling device 1. A thickness of the wall 12 in the first plate body 10 of the cooling device 1 and the subsequent testing pressure for the cooling device 1 are all related to specific requirements.

The above embodiments are only used to illustrate the technical solutions of the present application, and are not intended to limit the present application. Although the present application has been described in detail with reference to the aforementioned embodiments, those skilled in the art should understand that they can still modify the technical solutions recorded in the aforementioned embodiments or make equivalent substitutions for some of the technical features therein. These modifications or substitutions do not depart the essence of the corresponding technical solutions from the spirit and scope of the technical solutions in the embodiments of the present application, and should be included in the protection scope of the present application.

What is claimed is:

1. A cooling device, comprising:

a first plate body, wherein a first surface of the first plate body is provided with a flow channel for accommodating a fluid, the flow channel comprises two straight segments and one bent segment, the two straight segments are communicated via the one bent segment, and the two straight segments are separated by a channel partition, so that the flow channel formed by the at least two straight segments and the least one bent segment is as a "C" shape; and a second plate body;

wherein the first surface of the first plate body is in contact with the second plate body;

wherein an end of the flow channel is provided with an inlet and outlet nozzle, and the inlet and outlet nozzle is configured for the fluid entering into and exiting from the flow channel and is connected to the flow channel at an obtuse angle;

wherein a bottom surface of the flow channel in the first plate body is flat, and the bottom surface of the flow channel is level with a bottom surface of the inlet and outlet port.

2. The cooling device according to claim 1, wherein the first plate body and the second plate body are formed by casting.

3. The cooling device according to claim 1, wherein the first plate body and the second plate body are integrally formed by brazing.

4. The cooling device according to claim 2, wherein the first plate body and the second plate body are integrally formed by brazing.

5. The cooling device according to claim 1, wherein a bottom surface of the flow channel is provided with a micro rib structure.

6. The cooling device according to claim 3, wherein there are a plurality of micro rib structures, the plurality of micro rib structures are arranged within the flow channel in a staggered manner.

7. The cooling device according to claim 4, wherein there are a plurality of micro rib structures, the plurality of micro rib structures are arranged within the flow channel in a staggered manner.

8. The cooling device according to claim 1, wherein a first mounting hole is provided within the first plate body, the first mounting hole is located in at least one of the plurality of micro rib structures, and the first mounting hole is configured to mount a heating device.

9. The cooling device according to claim 1, wherein a first surface of the second plate body is in contact with the first surface of the first plate body, a strip-shaped protrusion is provided on the first surface of the second plate body, the strip-shaped protrusion overlaps with a part of the flow channel, and an extension direction of the strip-shaped protrusion is the same as an extension direction of the flow channel.

* * * * *